United States Patent [19]

Salice

[11] 4,007,514

[45] Feb. 15, 1977

[54] FIXED HINGE FITTING

[75] Inventor: Luciano Salice, Carimate (Como), Italy

[73] Assignee: S.A.R.L. Salice France, Nice, France

[22] Filed: Jan. 7, 1976

[21] Appl. No.: 646,983

[30] Foreign Application Priority Data

Jan. 17, 1975 France ..... 75.01535

[52] U.S. Cl. ..... 16/129

[51] Int. Cl.[2] ..... E05D 7/04

[58] Field of Search ..... 16/129–133, 16/134, 164, 163

[56] References Cited

UNITED STATES PATENTS

| | | | |
|---|---|---|---|
| 3,332,104 | 7/1967 | Leach | 16/130 |
| 3,772,735 | 11/1973 | Lautenschlaeger | 16/129 |
| 3,863,292 | 2/1975 | Granert et al. | 16/130 X |

*Primary Examiner*—G. V. Larkin
*Attorney, Agent, or Firm*—Wolf, Greenfield & Sacks

[57] ABSTRACT

A hinge mounting device for use with conventional doors or furniture doors may be easily mounted and adjustably positioned on the door frame or cabinet. The device includes a base plate which is attached to the furniture or door frame and a hinge fitting which is adjustably mounted to the base plate. The fitting carries the hinge mechanism. The base plate is elongate and has a pair of longitudinally extending grooves on its opposite sides. The hinge fitting is generally U-shaped in cross section to fit longitudinally over the top of the base plate, and has inwardly extending flanges which are received in the longitudinal grooves in the side of the base plate. A pair of screws are threaded through the top wall of the U-shaped fitting and are adjusted so that they may engage, selectively, the top surface of the base plate. One of the screws locks the fitting in a selected longitudinal position along the base plate and the other screw controls the angular position of the fitting with respect to the base plate.

11 Claims, 7 Drawing Figures

FIXED HINGE FITTING

BACKGROUND AND SUMMARY OF THE INVENTION

The present invention relates to a hinge mounting arrangement which facilitates and simplifies attachment of the hinge mechanism to a piece of furniture, a door frame or the like and which simplifies adjustment and positioning of the hinge and the door.

Although a variety of devices are known to facilitate attachment of a hinge to surfaces of a furniture door or door frame and in a manner which permits adjustment of the fitting in relation to those surfaces through small translating or rotating motions, the typical type of device has three elements including a base plate, a hinge support and a third element associated with the hinge support. These devices usually must be mounted and assembled in stages in which two of the elements must be connected together and adjusted before they are attached to the base plate and then a second adjustment is usually required after they have been mounted to the base plate. It is among the objects of the present invention to provide a hinge support which may be easily attached, fitted and adjusted by two screws carried by the fitting which provide a means to adjust both the longitudinal and angular positions of the hinge as well as to lock the hinge in that adjusted location.

In brief, the invention utilizes a base plate and a hinge fitting mounted to the base plate. The base plate is elongate and has a pair of longitudinal grooves formed on opposite of its sides. The hinge fitting is of somewhat U-shaped cross section, to fit, slideably, over the base plate. The ends of the side walls of the fitting have inwardly extending flanges which extend the length of the side walls and which are received in the longitudinal grooves of the base plate. One end of the fitting carries the movable, operative elements of the hinge. Positioning of the hinge elements is controlled by the longitudinal and angular position of the hinge fitting on the base plate and that, in turn, is adjusted and controlled by a pair of screws which are threaded through openings in the hinge fitting and cooperate with the base plate. The longitudinal grooves in the base plate have surfaces which are oriented at angles to permit the attitude of the hinge fitting to be adjusted by operation of one of the screws, the other screw being effective to lock the fitting in its selected orientation. In addition, the longitudinal grooves and/or the fitting flanges can be serrated to enhance locking of the fitting to the base plate.

DESCRIPTION OF THE DRAWINGS

The invention will be understood more fully from the following further description thereof, with reference to the accompanying drawings wherein.

DESCRIPTION OF THE PREFERRED EMBODIMENTS

Figures 1, 2, 3, 4, 5, 6, 7:
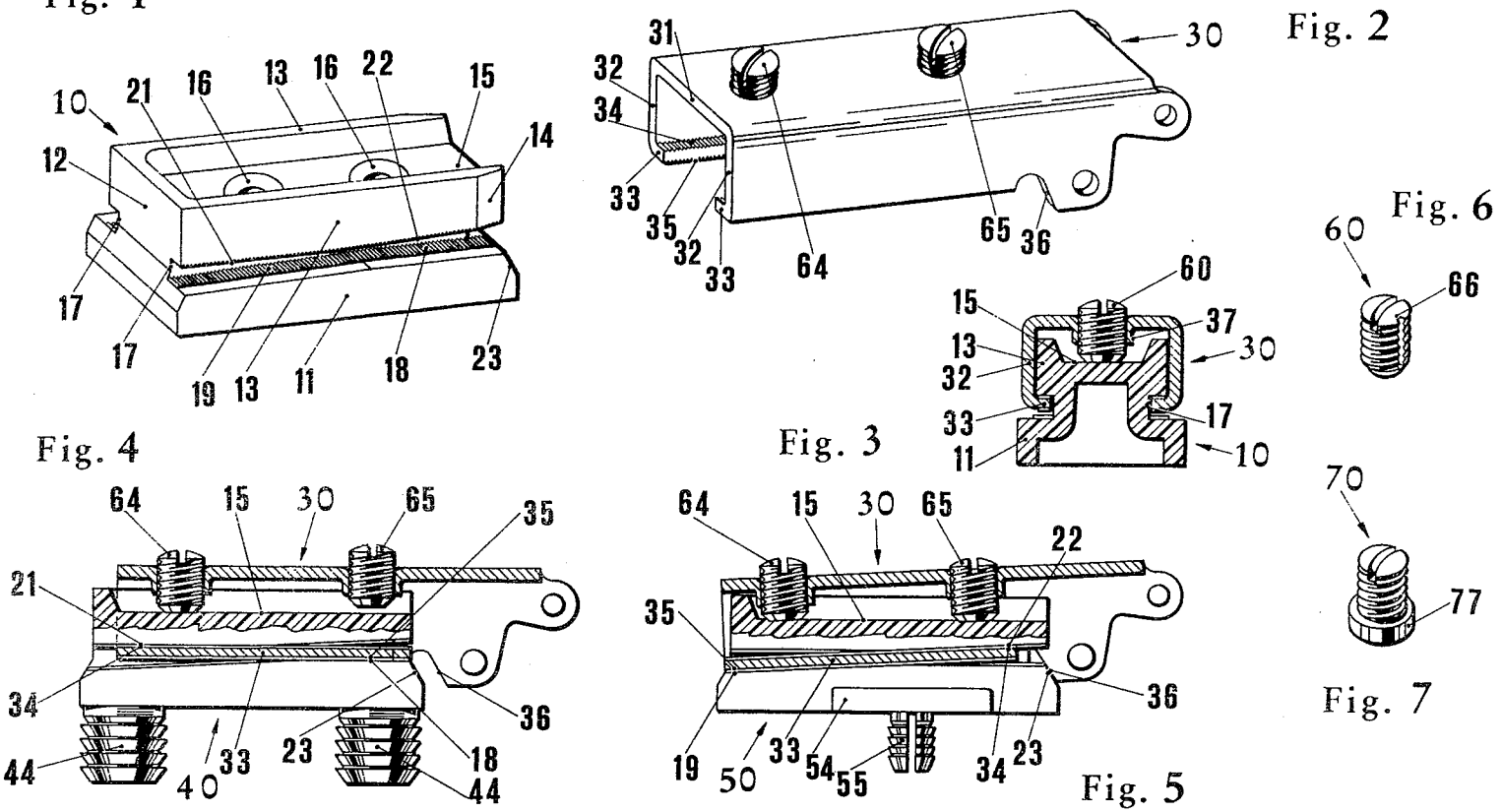
FIG. 1 is an illustration of the base plate.
FIG. 2 is an illustration of the hinge fitting.
FIG. 3 is a side elevation, in section, of the hinge fitting and base plate secured together.
FIG. 4 is an elevation of a modified base plate combined with the hinge fitting and adjusted to one typical position, illustrated partly in section.
FIG. 5 is an illustration similar to FIG. 4 showing a further modified type of base plate and illustrating the hinge fitting in an alternative orientation.
FIGS. 6 and 7 are illustrations of two types of screws which may be employed to adjust and lock the hinge fitting in place with respect to the base plate.

FIG. 1 shows the base plate 10 which is of elongate configuration. The upper surface 15 of the base plate 10 is recessed between a pair of upwardly extending, longitudinal walls 13. A pair of countersunk holes 16 extend downwardly through the base plate 10 to permit the base plate to be secured to the piece of furniture or door frame.

The sides of the base plate 10 are formed to define a pair of longitudinally extending grooves 17. The grooves 17 may be considered as defining the base plate into a lower portion 11 which bears directly against the furniture or doorjamb and an upper portion 12 which serves as a receptive guide for the hinge fitting (as will be described). The walls 13 of the upper portion 12 of the base plate 10 are beveled inwardly at one end, as shown at 14 in FIG. 1.

The hinge fitting 30, shown in FIG. 2, also is elongate and is of approximately U-shaped cross sectional configuration so that it may fit over the upper portion 12 of the base plate 10. The hinge support includes a main web 31 and a pair of downwardly extending side walls 32 which terminate in inwardly extending flanges 33. The hinge fitting 30 is shaped and dimensioned with respect to the base plate 10 so that it can be advanced over the upper portion 12 with its flanges 33 being received longitudinally in the longitudinally extending grooves 17. The hinge fitting 30 can be locked in any longitudinal position on the base plate 10 by means of a screw 64 which is threaded through an opening 37 in the main web 31 of the fitting 30 and the angular orientation of the fitting 30 on the base plate 10 can be controlled by a screw 65 also carried by a threaded hole 37 in the web 31 of the support 30. The threaded hole 37 may be formed within a downwardly extending bushing as shown.

The width of the grooves 17 is sufficient to permit the angular adjustment of the hinge support 30 on the base plate 10. As shown in FIG. 1, each of the grooves 17 may be considered as having a front portion and a rear portion. The lower surface 18 of the front portion parallels the upper surface 21 of the rear portion, both surfaces 18, 21 extend parallel to the bottom surface of the lower portion 11 of the base plate 10. The front portion of the upper surface 22 is inclined at an angle to surfaces 18 and 21 and extends parallel to the lower surface 19 of the rear portion of the groove 17. Thus, the grooves 17 can be considered as having forward and rearward portions which diverge in forward and rearward directions, respectively. The angular relationships of the surfaces 18, 19, 21, 22 of the grooves 17 cooperate with the flanges 33 of the hinge fitting 30 to define limits within which the hinge fitting may be angularly oriented. FIGS. 4 and 5 illustrate opposite extreme positions of angular orientation of the hinge fitting on the base plate 10.

When assembling and orienting the device, the base plate 10 is first attached to the furniture or doorjamb. The hinge fitting then is inserted over the upper portion 12 of the base plate 10, to the longitudinal position desired. The screw 64 then is tightened to lock the fitting 30 in the position shown in FIG. 4, in which the fitting extends parallel to the surface of the furniture or doorjamb. When in this position, the flanges 33 are engaged by the front lower surface 18 and upper rear surface 21 of the grooves 17.

Should it be desired to orient the hinge fitting 30 at an angle (as suggested in FIG. 5) the lock screw 64 is backed off slightly and the positioning screw 65 is tightened to bear against the upper surface 15 of the base plate to effect the desired angular orientation. Locking screw 64 then is retightened. When in the extreme angular position shown in FIG. 5, the flanges 33 of the hinge fitting 30 are in engagement with the front upper portion 22 and lower rear portion 19 of the grooves 17.

In order to facilitate rapid and easy attachment and adjustment, the locking screw 64 and angular adjustment screw 65 preferably are attached to the hinge fitting 30 at the factory and the screws 64, 65 preferably are of the non-removable type. For example, FIG. 6 shows one type of screw 60 which is provided with a longitudinal groove 66 which will prevent accidental removal. FIG. 7 shows an alternative screw 70 which has an enlarged collar 77 at its lower end which will be disposed below the main web 31 of the hinge fitting 30 to preclude its removal.

In order to enhance the grip between the flanges 33 of the hinge fitting 30 and the upper and lower surfaces of the grooves 17, the corresponding upper and lower surfaces 34, 35, respectively, of the flanges 33 may be provided with tooth-like serrations which can engage and cooperate with similar tooth-like serrations formed on the surfaces of the grooves 17.

The fitting 30 and base plate 10 may be provided with abutment means to limit the extent to which the fitting 30 can be advanced over the base plate 10 and also to provide further support for the device. To this end, the front end of the lower portion 11 of the base plate 10 is provided with a beveled abutment surface 23. The hinge fitting 30 has a pair of projections 36 which extend downwardly from the forward end of each of the side walls 32 which engage the abutment surface 23 and limit the extend to which the hinge fitting 30 can be advanced over the base plate 10. With the parts so assembled and with the locking screw 64 fastened, the structure is further rigidified by engagement of the projection 36 with the surface 23, as well as by engagement of the inner surfaces of the side walls 32 of the hinge fitting 30 with the side walls 13 of the upper portion 12 of the base plate 10. The hinge fitting 30 may be removed or longitudinally repositioned by simply loosening the locking screw 64 and repositioning the fitting 30, then retightening screw 64. Screw 65, which controls only the angular position of the hinge fitting 30, does not have to be locked.

FIGS. 4 and 5 also illustrate alternative devices by which the base plate may be attached to the furniture or door frame. In the embodiment shown in FIG. 4, the base plate 40 carries a pair of serrated fastening devices 44 which can be driven axially into preformed holes formed in the furniture or door frame and which are self locking to retain the base plate 40 in place without using any screws.

The embodiment shown in FIG. 5 includes a base plate 50 which carries two symmetrical laterally extending wings 54, each of the wings 54 carrying an expandable anchor pin 55. The pins 55 are urged into preformed holes and screws then are driven through the pins 55 to expand them and secure them in place.

Of course, the invention is not limited to the examples of embodiments described and depicted above, from which other modes and method of embodiment may be provided without departing from the scope of the invention.

Having thus described the invention, what is claimed is:

1. A hinge fixture comprising:

a base plate attachable to a wall member, the base plate having side walls and a pair of longitudinally extending grooves formed in each of the side walls;

a hinge fitting of generally U-shaped cross-sectional configuration adapted to fit over the top of the base plate, said hinge fitting having a pair of side walls which terminate in inwardly extending longitudinal flanges receptive in said grooves;

the main web of the hinge fitting having a pair of longitudinally spaced screws threaded therein for engagement with the upper surface of the base plate, one of said screws being effective to lock the hinge fitting to the base plate and the other of the screws being constructed and arranged to vary the angular position of the hinge fitting with respect to the base plate;

said longitudinally extending grooves in the base plate being dimensioned with respect to the flanges of the hinge fitting to permit limited angular adjustment of the hinge fitting with respect to the base plate.

2. A device as defined in claim 1 further comprising:

each groove having a forward portion and a rearward portion, each of the forward and rearward portions diverging in forward and rearward directions, respectively.

3. A device as defined in claim 2 further comprising:

the upper forward portion of each groove being parallel to the lower rearward portion of each groove; and the lower forward portion of each groove being parallel to the upper rearward portion of each groove.

4. A device as defined in claim 3 wherein the forward lower portion and rearward upper portion of each groove lie in planes which parallel the bottom surface of the base plate.

5. A device as defined in claim 1 further comprising:

said surfaces of said grooves being formed to define a series of serrated, tooth-like members.

6. A device as defined in claim 1 further comprising:

the forward end of the base plate having an abutment surface formed thereon;

the forward end of the hinge fitting having a projection extending downwardly therefrom for engagement with the abutment surface of the base plate to limit the rearward longitudinal position of the hinge fitting on the base plate.

7. A device as defined in claim 1 further comprising:

the upper surface of the base plate being surrounded by a side wall and defining a depression.

8. A device as defined in claim 1 further comprising:

the means for attaching the base plate to a member comprising a pair of screw holes formed through the base plate.

9. A device as defined in claim 1 wherein the means for attaching the base plate to the member comprises:

a pair of self-locking anchor pins attached to and extending from the bottom surface of the base plate.

10. A device as defined in claim 1 wherein the means for attaching the base plate to the member comprises:

a pair of expandable anchor pins attached to and extending from the bottom of the base plate;

a hole formed through the base plate in alignment with each of the expandable pins, said hole and pins being receptive to a screw to effect expansion of each of said bushings after insertion thereof into a hole formed in the member.

11. A device as defined in claim 1 further comprising:

said screws, hinge fitting and base plate being constructed and arranged to enable said screws to be operated independently of each other.

* * * * *